US005443393A

United States Patent [19]

Okumura et al.

[11] Patent Number: 5,443,393

[45] Date of Patent: Aug. 22, 1995

[54] LEVER TYPE CONNECTOR

[75] Inventors: Hitoshi Okumura; Osamu Taniuchi, both of Mie, Japan

[73] Assignee: Sumitomo Wiring Systems, Ltd., Mie, Japan

[21] Appl. No.: 182,338

[22] Filed: Jan. 18, 1994

[30] Foreign Application Priority Data

Jan. 19, 1993 [JP] Japan ..... 5-004317 U
Feb. 5, 1993 [JP] Japan ..... 5-008315 U

[51] Int. Cl.[6] ..... H01R 13/629
[52] U.S. Cl. ..... 439/157
[58] Field of Search ..... 439/152–160

[56] References Cited

U.S. PATENT DOCUMENTS 5,178,553 1/1993 Hatagishi et al. ..... 439/157
5,230,635 7/1993 Takenouchi et al. ..... 439/157
5,322,383 6/1994 Saito et al. ..... 439/157 X

FOREIGN PATENT DOCUMENTS 462772 2/1992 Japan .
2179506A 3/1987 United Kingdom .

*Primary Examiner*—Eugene F. Desmond

*Attorney, Agent, or Firm*—Sughrue, Mion, Zinn, Macpeak & Seas

[57] ABSTRACT

This invention aims to temporarily lock and smoothly couple and detach a lever type connector. After a hood 13 is opposed to a fitting portion 12*a*, the hood 13 is inserted into the fitting portion 12*a*, so that a lock portion 29 is clamped between an upper engaging projection 23 and a lower engaging projection 22. Then, a female connector housing 12 is temporarily locked in a male connector housing 11. At this time, a cam follower boss 20 is inserted into a cam groove 17 in an actuating lever 16 and both the housings 11 and 12 are coupled by turning the lever 16. In order to detach the housings from a coupled position, the lever 16 is turned from the coupled position to a detached position. Even if the female connector housing 12 is extracted from a right side area in the case that an extraction resistance at a left side area is larger than that at the right side area, the housing 12 abuts on the lower engaging projection 22*b* at the right area, thereby correcting an inclined posture. Thus, since the female connector housing 12 is always properly arranged in the male connector housing 11, it is possible to smoothly couple and detach the housings.

4 Claims, 7 Drawing Sheets

LEVER TYPE CONNECTOR

BACKGROUND OF THE INVENTION

1. Field of the Invention

This invention relates to a lever type connector which is coupled and detached by a lever and the like.

2. Statement of the Prior Art

There is a known lever type or bolt type connector. The connector has an advantage that it can be coupled and detached by a small force and can be applied to a multipole (i.e. more than twenty terminals) connector. For example, a basic construction of a lever type connector is known in Japanese Patent Public Disclosure No. 4-62772 (1992).

For convenience of explanation, a prior lever type connector will be explained below by referring to FIGS. 11 and 12.

FIGS. 11A to lid are schematic side elevation views of a prior lever type connector, illustrating a principle of the connector. FIG. 12 is a schematic longitudinal cross sectional view of the prior lever type connector, illustrating a problem in the prior connector.

As shown in FIG. 11A, the prior lever type connector comprises a male connector housing 1 in which a number of male terminals are mounted and a female connector housing 2 in which a number of female terminals adapted to receive the male terminals are mounted. A lever 3 provided with a cam groove 3*a* which effects a "lever action" is rotatably attached to the male connector housing 1. A cover 4 to be put on the female connector housing 2 is provided with engaging projection 4*a* at opposing center lower side walls.

In order to couple the connector housings 1 and 2 to each other, as shown in FIG. 11B, the engaging projection 4*a* on the cover 4 is engaged with the cam groove 3*a* in the lever 3 and then the lever 3 is turned to an anticlockwise direction shown by an arrow C. The cover 4 and female connector housing 2 are inserted into the male connector housing 1 by a cam action of the cam groove 3*a*. When the lever 3 is further turned to the anticlockwise direction c from a position shown in FIG. 11C to a position shown in FIG. 11D, the terminals in the connector housings 1 and 2 are interconnected against a mechanical insertion resistance, thereby finishing the coupling of the connectors.

In order to displace the lever type connector from a coupled position to a detached position, the lever 3 is turned to an opposite direction shown by an arrow D. At this time, since the female connector housing is rotatably coupled to the male connector housing at the center portion thereof, the female connector housing is often detached from the male connector housing while the former is slanted in the right or left side. For example, in a lever type connector shown in FIG. 12, a number of terminals are mounted. In particular, there is a hybrid type connector having many terminals 5 for an electrical power supply and many terminals 6 for a signal transmission. Since many signal terminals 6 having a low extraction resistance are disposed at the right side in FIG. 12 and many power terminals 5 having a high extraction resistance are disposed at the left side in the drawing, the extraction resistances are imbalanced.

The female connector housing 2 is detached by this imbalance of the extraction resistance while being slanted as shown in FIG. 12. Consequently, the female connector housing 2 is greatly inclined during detachment as shown in FIG. 12, the extraction resistance between the male terminals and the female terminals is increased and the lever 3 is hard or impossible to be turned. Further, if the lever is forced to be turned, the male terminals will be broken. In the case that the signal terminals 6 are shorter than the power terminals 5, the signal terminals 6 are extracted from the female terminals before the power terminals are extracted even if the extraction resistances are the same. Then, the extraction resistance is applied to only the power terminals 5, thereby causing imbalance of the extraction resistance.

Also, the lever type connector is sometimes displaced in a narrow space such as an inner deep space in an automobile compartment into which a worker can insert his or her hand with difficulty. Accordingly, it is desirable to temporarily lock the female connector housing 2 on the male connector housing 1 with the female connector housing 2 being detached from the male connector housing 1 in order to couple and detach the housing with one hand. Heretofore, when the cam follower boss 4*a* is inserted into the cam groove 3*a*, the boss 4*a* is temporarily locked in a temporarily locked portion in the cam groove 3*a*.

There are many large size connectors having a number of terminals in the lever type connector. Workers have been required to have the skill to correctly arrange the fitting portion 2*a* in the hood la when inserting the female connector housing 2 into the male connector housing 1. In addition, in the case that the connector is disposed in a narrow space where the worker can operate with only one hand, the above correct insertion will be more difficult. The lever type connector is coupled and detached around the cam follower boss 4*a* as a fulcrum shown in FIGS. 11A to 11D. If the female connector housing 2 is inserted into the housing 1 with the former being slanted, for example, in the left side in FIG. 12, the temporary lock portion in the cam groove 3*a* can not correct a posture of the housing 2.

When the lever 3 is turned in the slanted temporarily locked position, the lever 3 can hardly move on the housing 1 on account of the insertion resistance of both terminals. When the housing 2 is forced to be coupled to the housing 1, the terminals are incompletely interconnected, thereby causing a wrong contact and the like. Particularly, when the lever 3 is turned from the detached position to the coupled position, the worker will likely mistake that the connector housings are completely coupled even if they are incompletely coupled in the lever type connector. It has been desired heretofore to solve this problem.

SUMMARY OF THE INVENTION

A first object of the present invention is to provide a lever type connector in which a female connector housing is easily detached from the male connector housing.

A second object of the present invention is to provide a lever type connector in which the female connector housing is temporarily locked on the male connector housing and the former is smoothly coupled to and detached from the latter by using a temporary lock construction without making the connector large and complicated.

In order to achieve the first object, in a lever type connector of the present invention, male and female connector housings are provided with engaging means for correctly directing the female connector housing to the male connector housing on the way to a detached position from a coupled position.

The female terminals mounted in the female connector housing are connected to the male terminals mounted in the male connector housing. When the female connector housing is detached from the male connector housing, a lever is turned so that a cam follower boss is displaced in a cam groove. Even if there is any imbalance of extraction resistances between the female terminals and the male terminals, the female terminals are extracted from the male terminals while the former is slightly slanted. The female connector housing abuts on the engaging means provided on both housings at the side extracted first, thereby preventing further extraction of the housing and correctly directing the female connector housing to the male connector housing. That is, even if the female terminal (the female connector housing) is slightly slanted during extraction, the housing at the side extracted first abuts on the engaging means and the housing at the other side is extracted later, thereby correcting the inclination of the female connector housing.

According to the present invention, upon detaching the female terminals from the male terminals, it is possible to easily detach the female connector housing from the male connector housing by the engaging means for preventing the female connector housing from being slanted with respect to the male connector housing.

In order to achieve the second object, in the lever type connector, the male and female connector housings are provided with upper and lower engaging means opposed to each other and on the opposite sides thereof with respect to an insertion direction of the terminals, and wherein the upper and lower engaging means are common to one of the housings and formed into opposing lock projections to be clamped between the upper and lower engaging means in the other housing.

When the female terminals are coupled to the male terminals, the fitting portion of the female connector housing is disposed in opposition to the hood of the male connector housing and inserted into the hood. The lock projections are clamped between the upper and lower engaging means, thereby temporarily locking the female connector housing on the male connector housing. Since both engaging means are disposed in the inserting direction and opposed to each other, the female connector housing is correctly disposed in the male connector housing by the engaging means. The cam follower boss is put in the cam groove in the lever in the detached position, thereby enabling the lever to be turned.

Next, when the lever is turned from the correctly opposed position to the coupled position, the fitting portion-advances in the hood and the female terminals are coupled to the male terminals.

When the female terminals are extracted from the male terminals, the lever is turned from the coupled position to the detached position. At this time, if there is any imbalance of the extraction resistance at the right and left areas in the hood, the fitting portion is extracted first at the area where the extract resistance is low and it is slanted. The fitting portion abuts on the upper engaging means in the hood at the first extracted area and is limited as to further movement. Then, the terminals are extracted at the area where the extraction resistance is high and the fitting portion abuts on the upper engaging means at the area. Even if the female terminals (the female connector housing) is slightly slanted during extraction, the first extracted area abuts on the upper engaging means before the other area is extracted later, thereby refraining from a great inclination. Then, the female terminals are all extracted from the male terminals. At the detached position, the lock projections are clamped between the upper and lower engaging means, the female connector housing is temporarily locked on the male connector housing, and the female terminals are correctly opposed to the male terminals.

According to the connector of the present invention, since both the housings are provided with the upper and lower engaging means in the inserting direction and the upper and lower engaging means are common in one housing which is provided with the lock project ions to be clamped between the means, it is possible to temporarily lock the female connector housing on the male connector housing and effect engagement and detachment of the housings regardless of simple construction.

DETAILED DESCRIPTION OF THE PREFERRED EMBODIMENTS:

Referring now to FIGS. 1 to 10, embodiments of a lever type connector of the present invention will be explained below.

Figure 1:
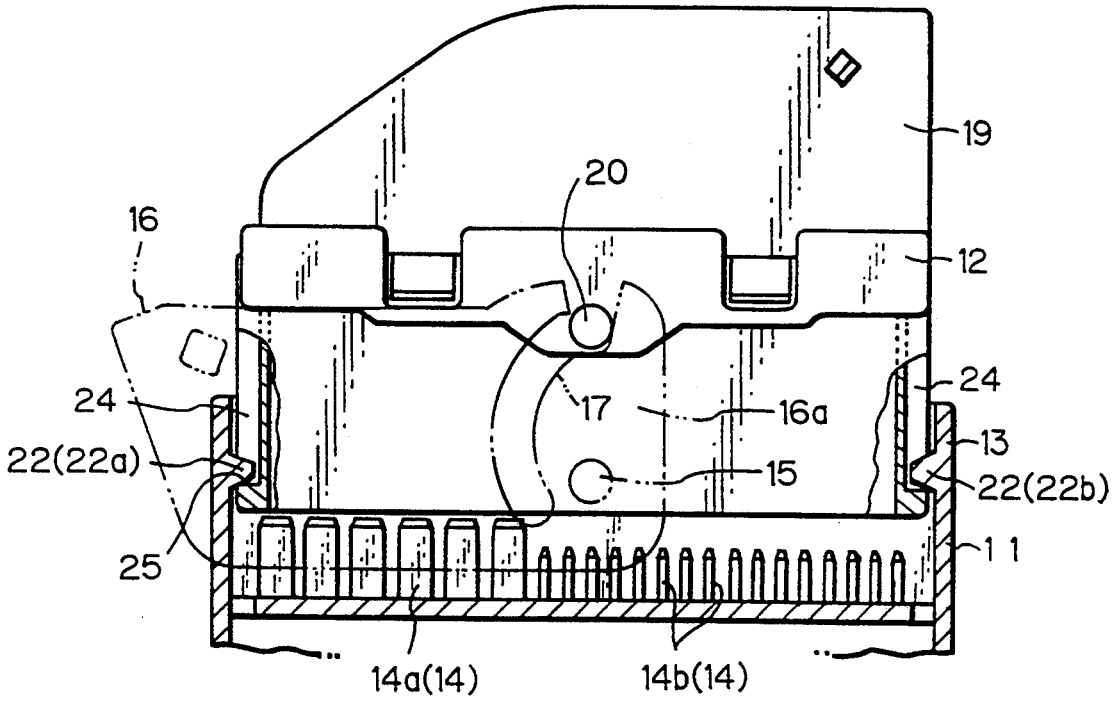
FIG. 1 is a partial cross sectional view of a first embodiment of a lever type connector in accordance with the present invention, illustrating a coupled position of the connector.

First, a first embodiment of the lever type connector of the present invention will be explained by referring to FIGS. 1 to 4. As shown in FIG. 1, the lever type connector comprises a male connector housing 11 and a female connector housing 12. The male connector housing 11 is provided with a hood 13 which receives the female connector housing 12 and mounts a number of male terminals 14 therein. The hood 13 is provided on opposed center portions with lever bearing shafts 15 on which two legs 16*a* of an actuating lever 16 are rotatably supported. Each leg 16*a* is provided with a cam groove 17 which is formed into a given arc about the lever bearing shaft 15. A cam follower boss 20 on the female connector housing 12, described in detail hereinafter, is adapted to engage with the cam groove 17 so that the female connector housing 12 is coupled to the male connector housing 11.

The male terminals 14 include relatively large terminals 14*a* for an electrical power supply at a left half area in FIG. 1 and relatively small terminals 14*b* for a signal transmission at a right half area in the drawing. In this embodiment, twelve power terminals 14*a* and thirty-two signal terminals 14*b* are arranged in two lines, respectively.

On the other hand, the female connector housing 12 is formed so as to be inserted into the hood 13 of the male connector housing 11 and is provided with a number of female terminals (not shown) corresponding to the male terminals 14. A cover 19 is put on the female connector housing 12 so that the cover 19 protects an electrical cable (not shown) connected to the female terminals.

Figure 11A:
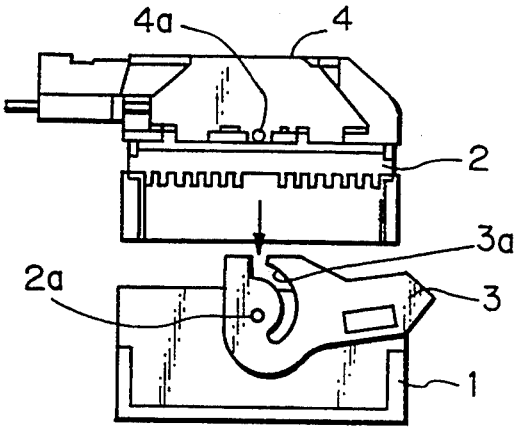
Fig. 11A PRIOR ART
FIGS. 11A to lid are side elevation views of a prior lever type connector, illustrating a principle of connection.
Figure 11B:
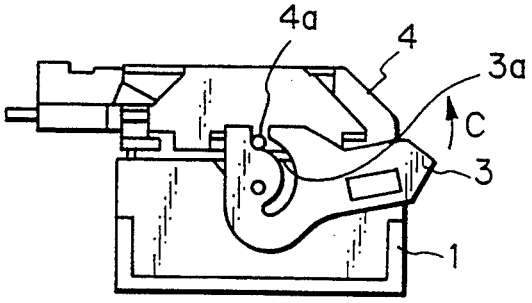
Fig. 11B PRIOR ART
Figure 11C:
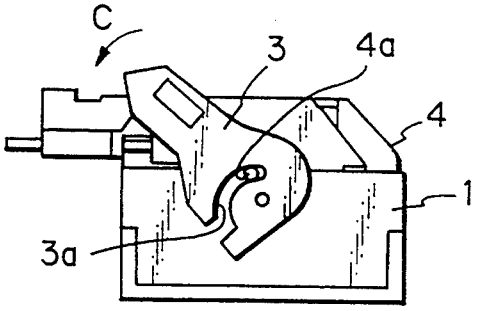
Fig. 11C PRIOR ART
Figure 11D:
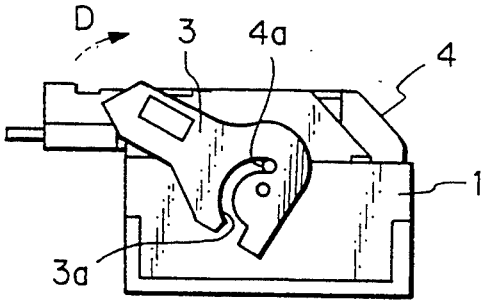
Fig. 11D PRIOR ART
Figure 12:
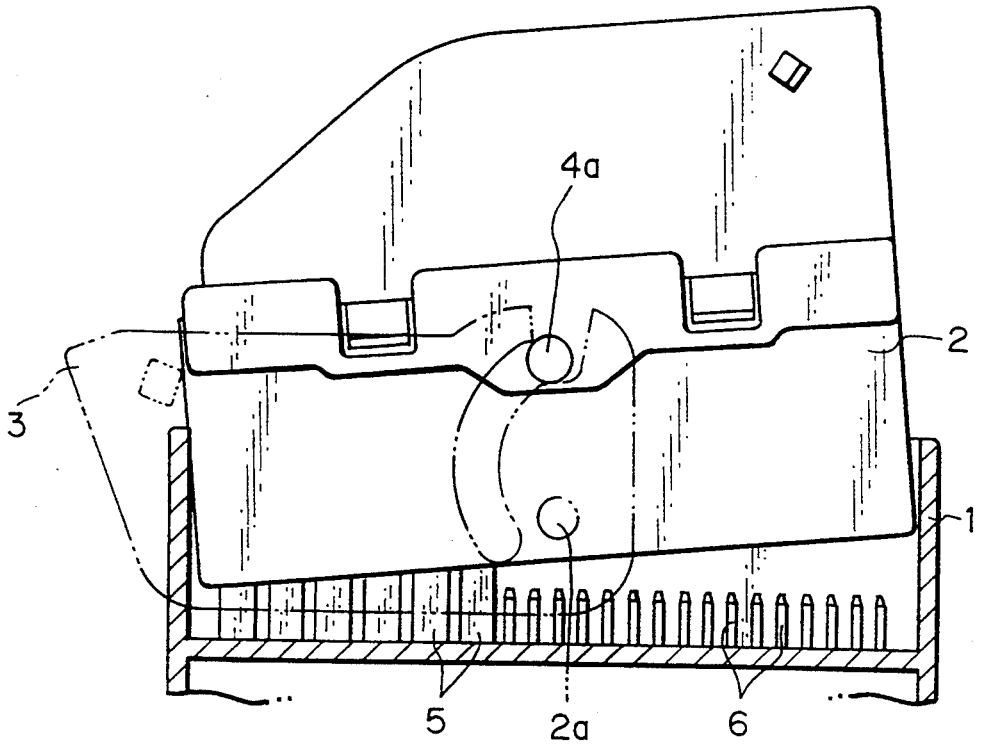
Fig. 12 PRIOR ART
FIG. 12 is a side elevation view of the prior lever type connector, illustrating a problem in connection.

The cover 19 is provided on opposing center portions with a pair of cam follower bosses 20 which project vertically and serve as a coupling mechanism in cooperation with the actuating lever 16. When the female connector housing 12 is inserted into the hood 13 of the male connector housing 11 with the cover 19 being put on the housing 12, the cam follower bosses 20 are inserted into the cam grooves 17 in the legs 16*a*, respectively. As shown in FIG. 11B, when the lever 16 is turned to a direction shown by an arrow C, the cam follower bosses 20 are pushed down along the cam grooves 17, the female connector housing 12 is displaced in the hood 13 against a mechanical insertion resistance of the male and female terminals, and finally the terminals are completely connected.

Figure 2:
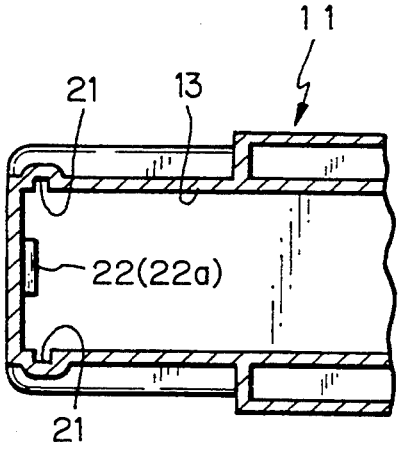
FIG. 2 is a partial cross sectional view of a male connector housing.

As shown in FIG. 2, the hood 13 of the male connector housing 11 is provided on opposed inner side walls with guide grooves 21 which extend along an insertion and extraction direction of the housing 12. Also, the hood 13 is provided on opposed inner end walls with engaging projections 22 (22*a* at a left side and 22*b* at a right side) which are arranged at a higher position than top ends of the power terminals 14*a*. The engaging projections 22 have upper and lower slanted face so that the female connector housing 12 is smoothly disengaged from the male connector housing 11 when the lever 16 is turned as described hereinafter.

Figure 3:
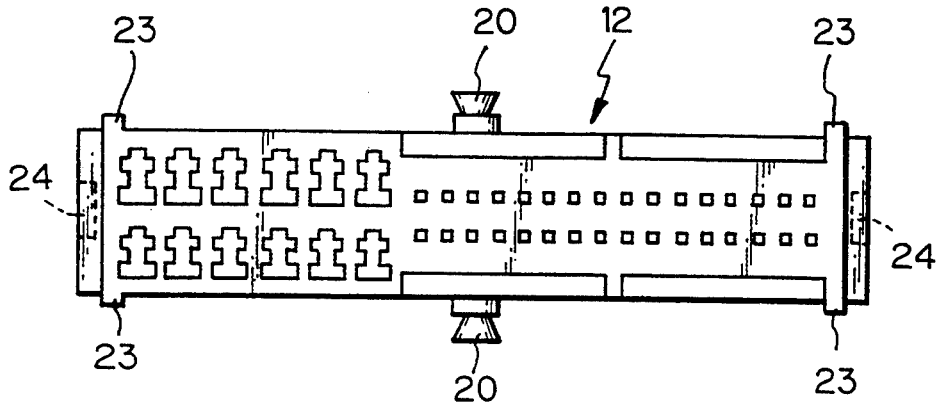
FIG. 3 is a rear side view of a female connector housing.

As shown in FIGS. 1 and 3, the female connector housing 12 is provided on both ends of opposed longitudinal side walls with four guide ribs 23 in total, which extend along the insertion direction of the housing 12. The guide ribs 23 fit in and move in the guide grooves 21 in the side walls of the hood 13 when the female connector housing 12 advances in the hood 13.

The female connector housing 12 is also provided on opposing longitudinal end walls with recesses 24 which extend the insertion and extraction direction. An abutment portion 25 is provided on a lower end of the recess 24. The abutment portion 25 constitutes a part of engaging means. The engaging projection 22 which constitutes a part of the engaging means is adapted to be mated in the recess 24. The engaging projections 22 and abutment portions 25 constitute the engaging means. The engaging projections 22 includes a left side one 22*a* and a right side one 22*b*. The abutment portion 25 is formed at a position where it engages with the engaging projection 22 when the lever 16 is turned to the finally detached position as shown in FIG. 1.

In the embodiment constructed above, an operation from the coupled position where the female connector housing 12 is coupled to the male connector housing 11 to the detached position where the housing 12 is detached from the housing 11 will be explained by referring to FIG. 4.

Figure 4:
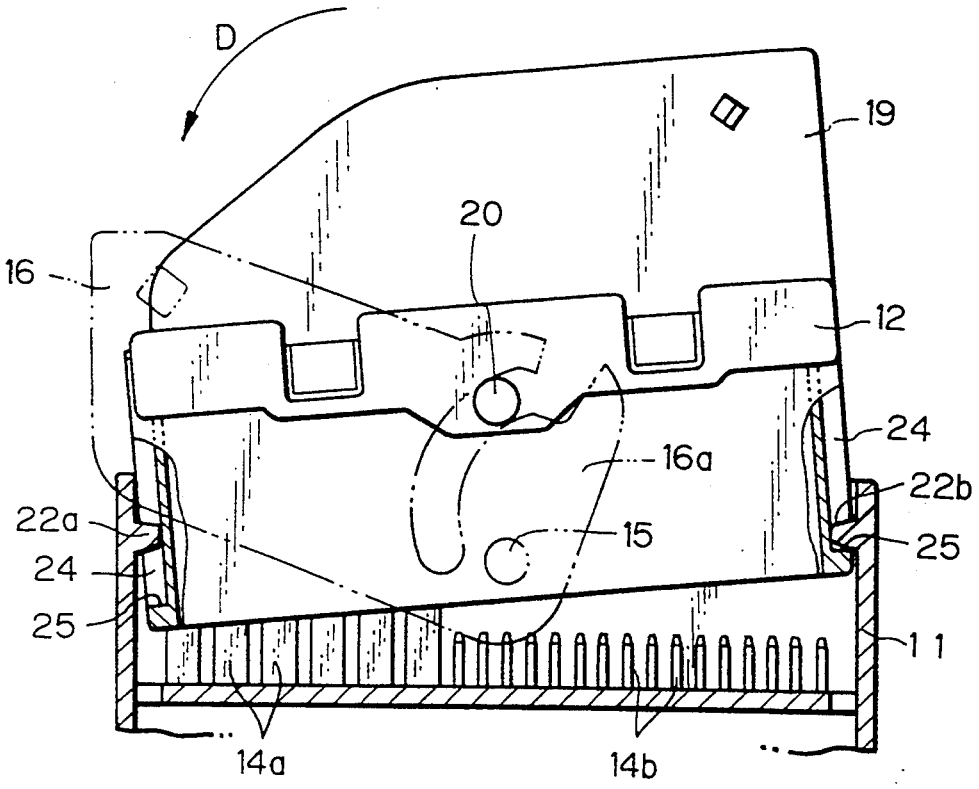
FIG. 4 is a partial cross sectional view of the first embodiment of the lever type connector of the present invention, illustrating a process for detaching the female connector housing.

When the male terminals 14 are coupled to the female terminals (not shown), the lever 16 is turned to the angular position shown in FIG. 4 in a direction shown by an arrow D. Then, since the extraction resistance in the left power terminals 14*a* is larger than that in the right signal terminals 14*b*, the right signal terminals 14*b* are extracted before the left power terminals 14*a* are extracted while the female connector housing 12 is being detached from the male connector housing 11. Consequently, the housing 12 is slanted upwardly at the right side. The abutment portion 25 in the lower end of the recess 24 abuts on the right engaging projection 22*b*, thereby stopping a further displacement.

When the lever 16, is further turned in the direction D, the left power terminals 14*a* are extracted by a lever action around an abutment point of the engaging projection 22*b* and abutment portion 25. Thus, the female connector housing 12 is not slanted so greatly in the hood 13 and is smoothly detached from the male connector housing 11 without making the extraction resistance large.

When the lever 16 is turned to the finally detached position shown in FIG. 1, the engaging projections 22*a* and 22*b* engage with the abutment portions 25 and 25. That is, the female connector housing 12 is correctly disposed in the male connector housing 11. The cam follower boss 20 is released in the cam groove 17. Accordingly, the cam follower boss 20 can be drawn from the cam groove 17 and the female connector housing 12 can be detached from the male connector housing 11.

The present invention should not be limited to the above embodiment. For example, the present invention can carry out following alternatives:

(a) Although the above embodiment is applied to a hybrid connector having two kinds of large power terminals and small signal terminals, the present invention may be applied to a connector in which a signal kind of terminals are mounted.

(b) Since the guide groove 21 guides the guide rib 23 in this embodiment, the female connector housing 12 is not slanted so greatly and is readily connected to the male connector housing 11. However, the guide groove 21 and guide rib 23 may be omitted in the present invention.

(c) Although the hood 13 of the male connector housing 11 is provided on the opposing side walls with the engaging projections 22 on which the abutment portion 25 abuts, the recess 24 may serve as an engaging hole and a lower end may serve as an abutment portion. The female connector housing 12 may be provided with an engaging projection which is adapted to engage with the engaging projection 22 of the male connector housing 11. Generally, means for correcting the slanted female connector housing 12 during turning of the lever 16 to the detached position may be provided.

The present invention is not limited to the above embodiment described in the description and drawings. The above embodiment may be altered within the scope of the spirit of the present invention.

A second embodiment of the present invention will be explained by referring to FIGS. 5 to 8.

Figure 5:
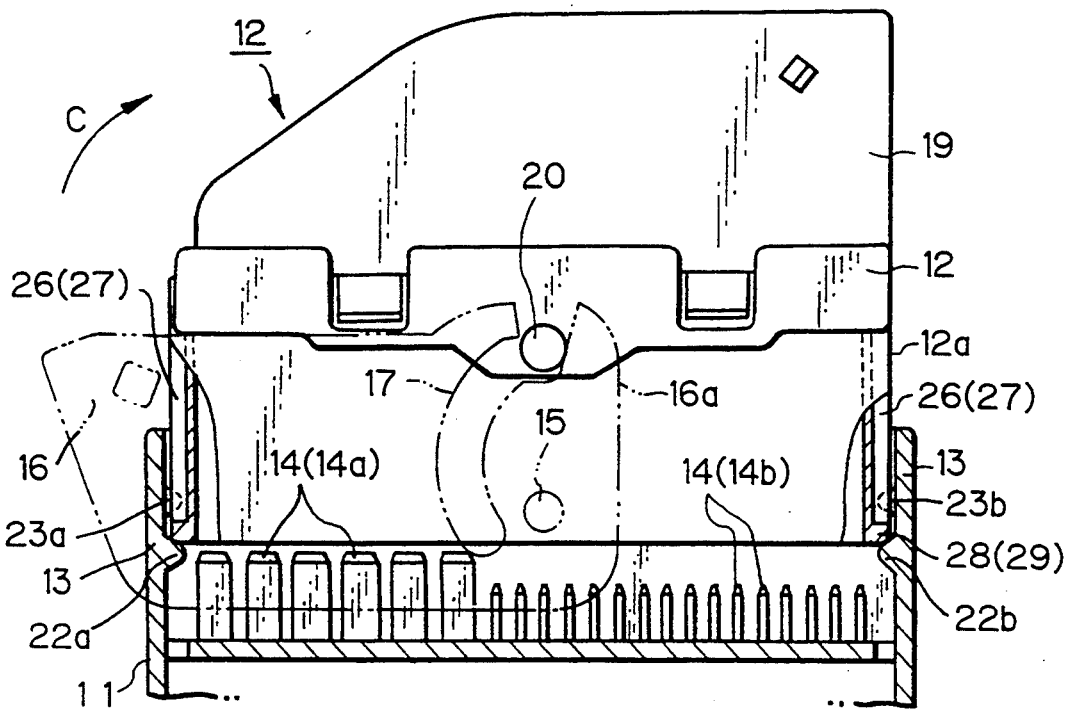
FIG. 5 is a cross sectional view of the connector in a temporary lock position.

As shown in FIG. 5, a lever type connector of the present invention includes a male connector housing 11 and a female connector housing 12. The male connector housing 11 is provided with a hood 13 which receives the female connector housing 12 and mounts a number of male terminals 14 therein. The hood 13 is provided on opposed center portions with lever bearing shaft 15 on which two legs 16*a* of an actuating lever 16 are rotatably supported. Each leg 16*a* is provided with a cam groove 17 which is formed into a given arc about the lever bearing shaft 15. A cam follower projection 20 on the female connector housing 12, described in detail hereinafter, is adapted to engage with the cam groove 17 so that the female connector housing 12 is coupled to the male connector housing 11.

Figure 6:
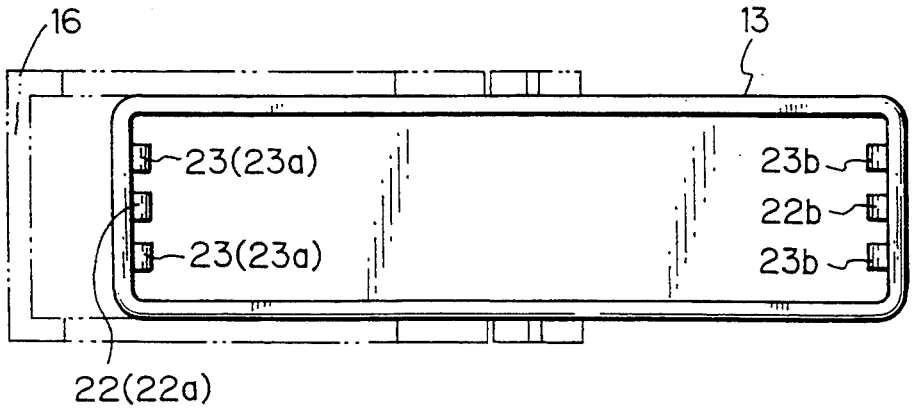
FIG. 6 is a plan view of a male connector housing, from which male terminals are removed, in a second embodiment of the lever type connector in accordance with the present invention.
Figure 7A:
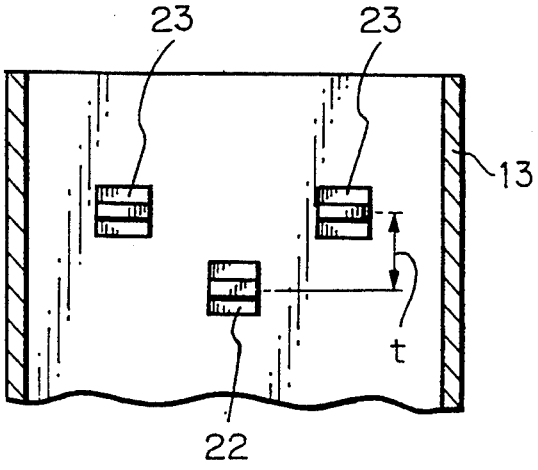
FIGS. 7A and 7B are partial cross sectional views of hoods in the second embodiment.

As shown in FIG. 6, the hood 13 of the male connector housing 11 is provided on opposed end walls with lower engaging projections 22 (22*a* at the left side and 22*b* at the right side) and with upper engaging projections 23 (23*a* at the left side 23*a* and 23*b* at the right side) which are arranged on both sides of the projections 22 and spaced above them by a given distance t (see FIG. 7A). The lower engaging projections 22 is formed at a position where the cam follower boss 20 is inserted in the cam groove 17 with a fitting portion 12*a* being inserted in the hood 13 as shown in FIG. 5. At this position, the female terminals not shown are not contacted with and are detached from the male terminals 14. The lower and upper engaging projections 22 and 23 have upper and lower slanted face so that the female connector housing 12 is smoothly released from the male connector housing 11 when the lever 16 is turned.

The upper and lower engaging projections 22 and 23 constitute a part of upper and lower engaging means.

Figure 7B:
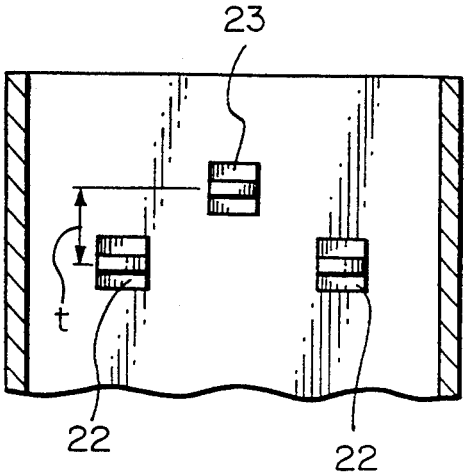

As shown in FIG. 7B, the upper engaging projection 23 may be provided at a center on the end wall and the lower engaging projections 22 may be provided on the both sides of the upper engaging projection 23.

Figure 8:
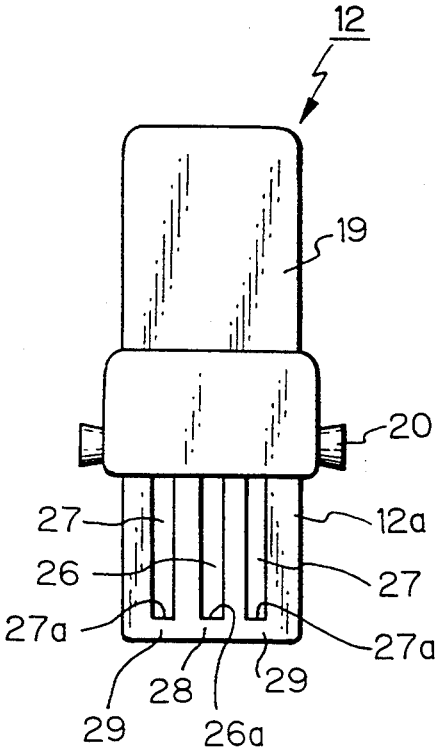
FIG. 8 is a side elevation view of a female connector housing in the second embodiment of the present invention.

On the other hand, as shown in FIGS. 5 and 8, the female connector housing 12 is provided on the fitting portion 12*a* with recesses 27, 26 and 27 which extend along the insertion and extraction direction and correspond to the lower and upper engaging projections 22 and 23, 23. The engaging projections 23, 22, and 23 are adapted to be inserted into the recesses 27, 26 and 27, respectively. Lock portions 29, 28 and 29 are defined between the bottom faces 27*a*, 26*a* and 27*a* in the recesses 27, 26 and 27 and the end face of the fitting portions 12*a*. The lock portions 29, 28 and 29 constitute a common part of the upper and lower engaging means.

Next, an operation of the second embodiment will be explained upon coupling the female connector housing 12 to the male connector housing 11.

The female connector housing 12 is inserted into the hood 13 while the former is opposed to the latter as correctly as possible. At this time, even if the housing 12 is inserted in the hood in a little slanted posture, the lower end of the fitting portion 12*a* abuts on the upper engaging projections 23*a* and 23*b*, thereby correcting the slanted posture of the female connector housing 12 with respect to the male connector housing 11. When the female connector housing 12 is further pushed down in the hood 13, the lower end of the fitting portion 12*a* abuts on the lower engaging projections 22*a* and 22*b*, as shown in FIG. 5. Then, the lock portions 29, 28 and 29 are clamped between the upper engaging projections 23*a*, 23*b* and the lower engaging projection 22*a*, 22*b*, so that the female connector housing 12 is temporarily locked in the male connector housing 11, as shown in FIG. 5. Accordingly, even if the female connector housing 12 is inserted into the male connector housing 11 in the slanted posture, the housing 12 is corrected by the upper engaging projections 23*a*, 23*a* or 23*b*, 23*b* and then the housing 12 is properly disposed in the housing 11. At this time, the cam follower boss 20 mates with the cam groove 17 in the lever 16 in the detached position. Then the lever 16 can be turned to a direction shown by an arrow C in FIG. 5.

When the lever 16 is turned from the detached position to the coupled position, the female connector housing 12 is pushed down by a large force caused by the lever action so that the temporary lock of the housing 12 is released from the lower engaging projections 22. Consequently, the female connector housing 12 advances more deeply in the male connector housing 11, thereby completely connecting the female terminals to the male terminals 14 and finishing coupling the connector.

On the other hand, when the female connector housing 12 is detached from the male connector housing 11 from the coupled position, the lever 16 is turned to a detached position from the coupled position. During this process, since the extraction resistance at the left power terminals 14*a* is larger than that at the right signal terminals 14*b*, the right signal terminals 14*b* are extracted in the female connector housing 12 before the left power terminals 14*a* are extracted and the female connector housing 12 is slanted upwardly at the right side. The lock portion 28 abuts on the right lower engaging projection 22*b* so that the right side is stopped from being extracted. When the lever 16 is further turned the female connector housing 12 is turned around the abutment point of the lower engaging projection 22*b* and lock portion 28 at the right side while correcting the slanted posture. Then, the opposite ends of the fitting portion 12*a* abut on the lower engaging projections 22*a*. The opposite ends clear the lower engaging projections 22*a* and 22*b* and leave them. Thus, the fitting portion 12*a* is not inclined so greatly in the hood 13, the female connector housing 12 is smoothly detached from the male connector housing 11, and the housing 12 is held in the temporary lock position shown in FIG. 5.

Figure 9:
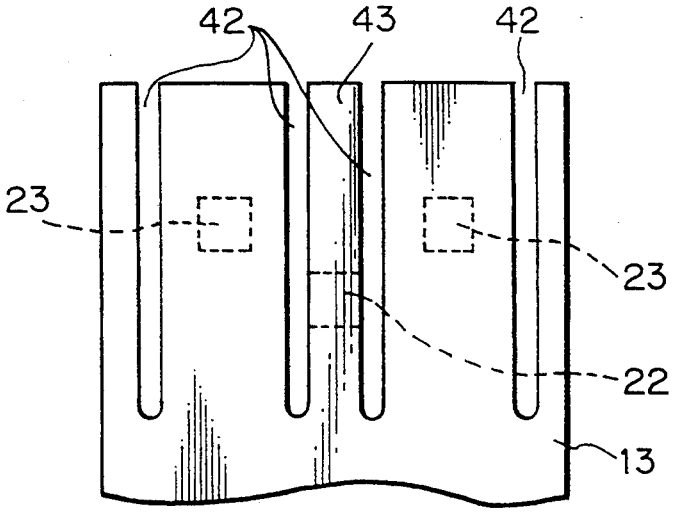
FIG. 9 is a side elevation view of the hood in the second embodiment of the lever type connector of the present invention.
Figure 10:
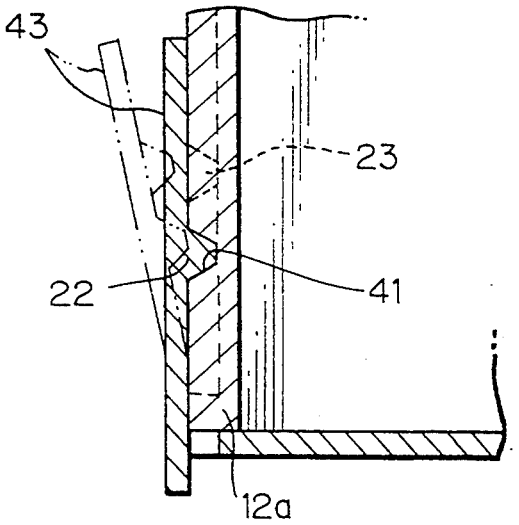
FIG. 10 is a partial cross sectional view of the second embodiment, illustrating a connecting relationship between the hood and a fitting portion.

Next, a third embodiment of the present invention will be explained by referring to FIGS. 9 and 10. Although the fitting portion 12*a* is provided with a recess 24 in which the lower engaging projection 22 moves in the second embodiment, the fitting portion 12 is provided with not the recess 24 but a recess 41 in which the lower engaging projection 22 is inserted when the female connector housing 12 is coupled in the male connector housing 11 in the third embodiment. The hood 13 is provided on the opposing end walls with two slits 42 which extend to an upper top edge of the wall and on the both sides of the lower engaging projection. The slits 42 form a leaf spring 43 which can be elastically deflected by the lower engaging projection 22. When the female connector housing 12 is displaced from the temporarily locked position to the coupled position, the leaf spring 43 is deflected by the lower engaging projection 43. The projection 43 fits in the recess 41 when the housing 12 is moved to the coupled position. Thus, in the third embodiment the lower engaging projection 22 fits in the recess 41 so that the female connector housing 12 is locked in the male connector housing 11.

During the detaching process, the lock portions 28 and 29 abut on the upper engaging projection 23 and the female connector housing 12 is turned about the abutment point so as to correct the slanted posture.

The present invention is not limited to the second and third embodiments. For example, the present invention may be altered as follows.

(a) Although the hood 13 has the same depth as the conventional hood shown in FIGS. 11A to 11D in the second and third embodiments, the hood 13 may have a shorter depth within an allowance of a limitation due to a lever mechanism.

(b) Although the second and third embodiments are applied to a hybrid connector housing two kinds of large power terminals and small signal terminals, the present invention may be applied to a connector in which a single kind of terminals are mounted.

(c) Although the hood 13 of the male connector housing 11 is provided on the opposed end walls with the lower engaging projection 22 on which the top side ends of the female connector housing 12 abut in the second embodiment, the engaging projection which serves to correct the slanted female connector housing 12 with respect to the male connector housing 11 in the coupled position may be altered in another form. The engaging projection may be provided on not only the right and left side walls shown in FIG. 6 but also the front and rear end walls.

(d) Although the hood 13 of the male connector housing 11 is provided on the opposing end walls with the engaging projections 22 and 23 between which the lock portions 28 and 29 are clamped in the second embodiment, the engaging projections may be provided on the fitting portion 12*a* while the lock portions may be provided on the hood 13. These elements may be altered so long as they can serve to maintain the female connector housing 12 in the temporarily locked position and to correct the slanted housing 12 during the detaching process of the lever 16.

(e) Although the leaf spring 43 is defined by the two slits 42 which extend to the upper top edge and on both sides of the lower engaging projection 22 in the third embodiment, the slits may extend to not the upper top edge but intermediate portion so that the lower engaging projection 22 serves as a spring.

(f) Although the recess 24 is formed in the second embodiment and the leaf spring 43 is defined by the slits in the third embodiment so that the fitting portion 12*a* can be inserted into the hood 13, both of the recess 24 and slits 42 may be provided. In this construction, the lock portion can easily ride across the lower engaging projection 22 by the action of the leaf spring 43 and the lever 16 can be more easily actuated.

(g) Although the leaf spring 43 is defined by the two slits which extend to the upper top edge and both sides of the lower engaging projection 22 in the third embodiment, the slits may be formed on the both sides of the upper engaging projection 23 so that the projection 23 can displace in the same manner as the third embodiment.

The present invention should not be limited to the above embodiments disclosed in the description and drawings. The above embodiments may be altered within the scope of the spirits of the present invention.

What is claimed is:

1. A lever type connector comprising a male connector housing having a hood in which male terminals are mounted; an actuating lever rotatably attached to said connector housing and provided with cam grooves in two legs thereof; and a female connector housing adapted to be coupled to said male connector housing, provided with cam follower bosses to be engaged with said cam grooves, and having a fitting portion to be coupled to said hood, said fitting portion mounting female terminals to be coupled to said male terminals therein, said lever being turned from a detached position where said cam follower basses are disposed in an inlet of said cam groove to a coupled position where said female terminals are coupled to said male terminals and vice versa, said male and female connector housings are provided with a first set of engaging means opposed to each other and a second set of engaging means opposed to each other and further recessed from said first set with respect to an insertion direction of said terminals, and wherein said first and second sets of engaging means are common to one of said housings and formed into opposing lock projection to be clamped around first and second engaging means in the other housing.

2. A lever type connector according to claim 1, wherein said female connector housing is provided on said fitting portion with recesses which extend in said insertion direction and are associated with a first set of engaging projections in said male connector housing and wherein said first set of engaging projections are received in said recesses.

3. A lever type connector according to claim 2, wherein said female connector housing is provided with fitting recesses to receive a lower set of engaging projections in said coupled position, and wherein said hood is provided on opposite side walls with two slits which extend upwardly on the opposite sides of said lower set of engaging projections, and wherein said lower set of engaging projections are displaced by means of a leaf spring defined by said slits.

4. A lever type connector according to claim 2, wherein said female connector housing is provided with fitting recesses to receive a upper set of engaging projections in said coupled position, and wherein said hood is provided on opposite side walls with two slits which extend upwardly on the opposite sides of said upper set of engaging projections, and wherein said upper set of engaging projections are displaced by means of a leaf spring defined by said slits.

* * * * *